US007080752B2

(12) United States Patent
Bergeron

(10) Patent No.: US 7,080,752 B2
(45) Date of Patent: Jul. 25, 2006

(54) DRINKING CONTAINER

(76) Inventor: Bryan Bergeron, 212 Maloney Rd., Des Allemands, LA (US) 70030

( * ) Notice: Subject to any disclaimer, the term of this patent is extended or adjusted under 35 U.S.C. 154(b) by 830 days.

(21) Appl. No.: 09/992,328

(22) Filed: Nov. 19, 2001

(65) Prior Publication Data

US 2002/0070225 A1 Jun. 13, 2002

Related U.S. Application Data

(60) Provisional application No. 60/251,783, filed on Dec. 8, 2000.

(51) Int. Cl.
*B65D 25/42* (2006.01)

(52) U.S. Cl. ..... 220/703; 220/717

(58) Field of Classification Search ..... 220/717
See application file for complete search history.

(56) References Cited

U.S. PATENT DOCUMENTS 4,146,157 A * 3/1979 Dixon et al. ..... 222/424
4,235,348 A * 11/1980 Watson
5,323,928 A 6/1994 Stevens
5,645,191 A * 7/1997 Neville ..... 220/717
5,899,354 A 5/1999 Garcia
5,950,857 A * 9/1999 Rosen
6,082,583 A 7/2000 Bussell et al.

* cited by examiner

*Primary Examiner*—Stephen Castellano
(74) *Attorney, Agent, or Firm*—Wyatt, Tarrant & Combs, L.L.P.

(57) ABSTRACT

A drinking container for assisting a disabled person in drinking a fluid by reducing the degree of tilt necessary to drain the fluid from the container into the person's mouth comprising a fluid holding vessel having an upper rim and a closed bottom, the upper rim having an opening through at least a sipping region thereof, and a fluid diverter member contiguous with an inner surface and the bottom of the vessel. The diverter member slopes downward substantially from the sipping region of the rim toward an opposing side of the vessel such that when the bottom of the vessel is pivoted upward about the sipping region of the rim, the diverter member compels fluid through the sipping region. The fluid diverter member is preferably wedge shaped. A flow channel preferably extends lengthwise along an outer surface of the fluid diverter member.

15 Claims, 6 Drawing Sheets

SIDE VIEW

TOP VIEW

DRINKING CONTAINER

CROSS REFERENCE TO RELATED APPLICATIONS

This application is a continuation of and claims priority to Provisional Patent Application Ser. No. 60/251,783 filed Dec. 8, 2000, which is pending.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to drinking containers, and more particularly to drinking containers that are easy to empty and therefore adapted particularly for use by paralyzed, immobile and other movement impaired individuals.

BACKGROUND OF THE INVENTION

Drinking containers such as mugs, cups, and glasses have been known and used for hundreds of years. Prior art drinking containers are conventionally provided with an interior sidewall that is vertical throughout a particular cross-section and length of the container. A vertical sidewall maximizes the volume of fluid that may be contained in a container of a given height. Some drinking containers have an interior sidewall that extends radially outward along a bottom region thereof in order to maximize volume and prevent the container from tipping over. Other drinking containers have an interior sidewall that curves radially inward along a bottom region thereof or that extends radially outward along a top region thereof. These latter applications are ornamental in nature. However, all of these drinking containers have a substantially vertical interior sidewall along a particular cross-section and length thereof. When a drinking container has such a vertical sidewall, it is necessary to tilt the vertical sidewall past horizontal in order to drain all drinking fluid from the container.

Some disabled individuals have difficulty drinking or are entirely unable to drink from conventional drinking containers that require tilting. Such problems are encountered by paralyzed individuals; individuals who are immobilized by illness, such as nerve or muscular disorders; elderly individuals; and by individuals suffering from temporary or permanent injuries to the hand, wrist, arm, or shoulder.

Disabled individuals can catch pneumonia by drinking from conventional drinking containers. When a disabled individual tilts his or her head back in order to drain fluid from a drinking container, residual amounts of drinking fluid may drain into the individual's lungs. The presence of liquid in the lungs facilitates infection by bacteria or viruses, resulting in pneumonia. If a disabled person is already in a weakened condition, catching pneumonia can be fatal.

U.S. Pat. No. 5,323,928 (Stevens) provides a cup that assists individuals who suffer from dysphasia, a condition associated with difficulty swallowing. This is accomplished by providing a cup having an upwardly extending, elliptically-shaped sidewall defining an elliptical aperture at its apex. The elliptical aperture is sized to accommodate a person's nasal bridge during drinking such that substantial backwards angulation of the head is not required. When the cup is tilted to empty the contents of the cup, the user does not hit his or her nose on the cup or have to tilt his or her head back to empty the cup. The cup includes a handle disposed 90 degrees out from the major axis of the elliptical aperture.

U.S. Pat. No. 5,899,354 (Garcia) provides a drinking mug having a nose bridge receptacle and a pair of eye relief channels formed on either side of the nose bridge receptacle. The mug is disclosed as having a vertical interior sidewall.

There remains a need for a drinking container that empties completely with minimal tilting of the container about a horizontal axis.

OBJECTS AND SUMMARY OF THE INVENTION

It is an object of the invention to provide a drinking container that can be readily emptied of drinking fluids with minimal tilting of the drinking container.

It is another object of the invention to provide a drinking container that incorporates a wedge member having a flow channel to assist in channeling and draining of fluid from the container.

It is another object of the invention to provide a drinking container that is particularly designed to assist disabled individuals.

It is yet another object of the invention to provide a drinking container that prevents or decreases the incidence of flow of residual drinking fluids into the lungs of disabled individuals, thereby preventing related medical conditions such as pneumonia.

These and other objects and advantages of the invention shall become apparent from the following general and preferred description of the invention.

Accordingly, a drinking container for assisting a disabled person in drinking a fluid by reducing the degree of tilt necessary to drain the fluid from the container into the person's mouth is provided comprising, generally, a fluid holding vessel having an upper rim and a closed bottom, the upper rim having an opening through at least a sipping region thereof, and a fluid diverter member contiguous with an inner surface and the bottom of the vessel. The diverter member slopes downward substantially from the sipping region of the rim toward an opposing side of the vessel such that when the bottom of the vessel is pivoted upward about the sipping region of the rim, the diverter member compels fluid through the sipping region. The fluid diverter member is preferably wedge shaped.

A flow channel preferably extends lengthwise along an outer surface of the fluid diverter member. The flow channel is positioned and configured to assist the fluid diverter member in compelling fluid through the sipping region.

The sipping region may comprise an extension spout extending upward and outward from the upper rim, the extension spout being contiguous with the fluid diverter member to thereby assist the fluid diverter member in compelling fluid through the sipping region.

One or more handles can be provided on an outer surface of the vessel. The handle is preferably positioned at about ninety degrees relative to the sipping region. A second handle can be positioned at about 270 degrees relative to the sipping region.

The drinking container can be provided with a lid configured to removably seal the upper rim. The lid has an extension spout configured to extend the fluid diverter member upward and outward to thereby assist the fluid diverter member in compelling fluid through the sipping region.

The drinking container of the invention is used by filling the container with a drinking fluid, placing the sipping region of the drinking container on a lower lip of a mouth of a user, maintaining the user's head in a substantially fixed orientation, and rotating the bottom of the container about the lower lip of the user to thereby compel the fluid to flow through the sipping region. When used in this manner, the fluid diverter member decreases the degree of tilt required to drain the fluid from the container into the user's mouth.

PREFERRED EMBODIMENTS OF THE INVENTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1B:
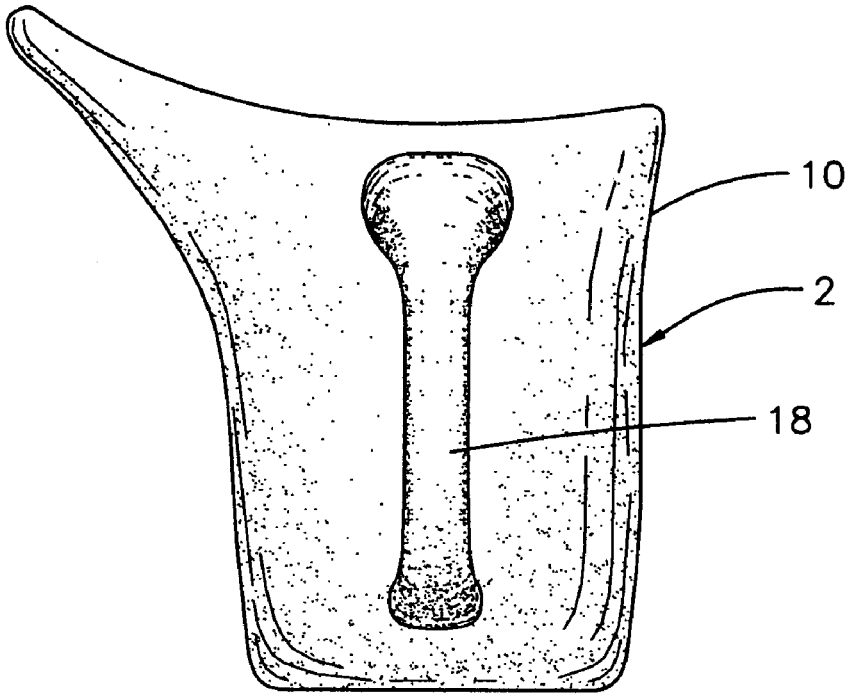
FIG. 1B is an external side view of the drinking container of FIG. 1A.

The invention provides an easily emptied drinking container that is designed particularly for disabled persons who have difficulty drinking from conventional cups. As shown in FIG. 1, the invention includes a fluid holding vessel or hollow container portion 2 formed by a sidewall 10. The vessel 2 has an upper rim 16 and a closed bottom or base 6. The upper rim 6 has an opening through at least a sipping region 16A thereof. The container 2 preferably has a cylindrical outer wall, but may be provided with other configurations, such as square or elliptical, without departing from the spirit and scope of the invention. The outer bottom surface of the vessel 2 is preferably configured to hold the vessel 2 in an upright position when the bottom surface is rested on a flat surface, such as a table top.

Figure 1A:
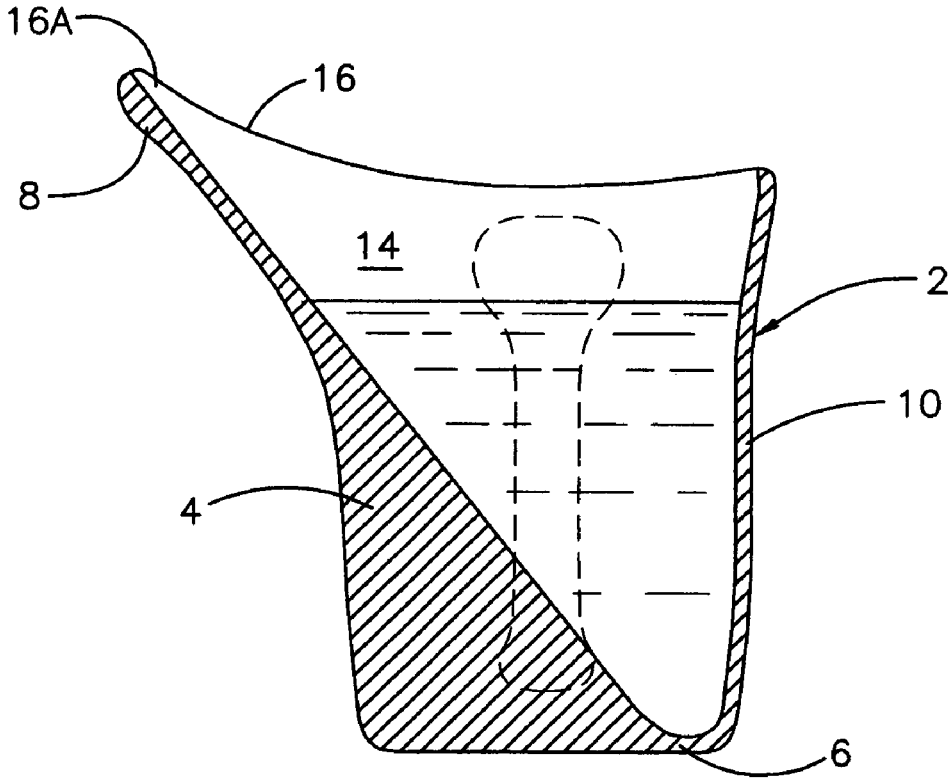
FIG. 1A is a cross section side view of a preferred embodiment of a drinking container for disabled persons according to the invention, showing a cross section of a fluid diverter member.
Figure 1C:
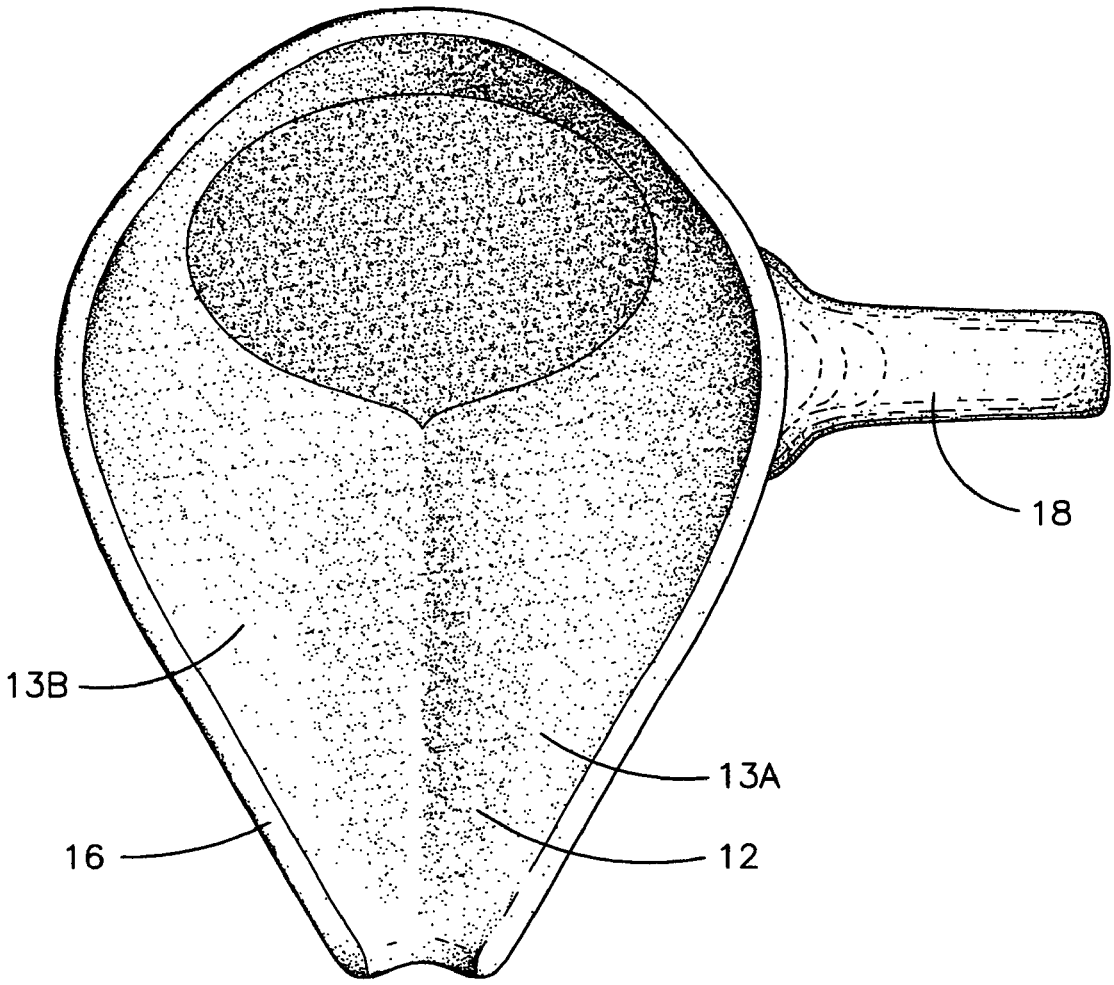
FIG. 1C is a top view of the drinking container of FIG. 1A, showing details of a fluid diverter member.

As shown in FIG. 1A, the vessel 2 includes a fluid diverter member 4 disposed generally along one side of the container 2. The fluid diverter member 4 is contiguous with an inner surface and the bottom 6 of the vessel 2, such that fluid cannot seep behind the fluid diverter member 4. The diverter member 4 slopes downward substantially from the sipping region 16A of the rim toward an opposing side of the vessel such that when the bottom 6 of the vessel 2 is pivoted upward about the sipping region 16A of the rim 16, the diverter member 4 compels fluid through the sipping region 16A, and in to the mouth of a user. As shown in the side view of FIG. 1A, the fluid diverter member 4 is preferably wedge shaped. Because of the fluid diverter member 4, the cup or container 2 will empty with a minimal tilting angle. This internal wedge 4 forces all liquid in the container against the opposing wall of the container 2. The wedge member 4 can also be provided in the form of a preformed insert that is sized to fit into an existing drinking container, such as a conventional coffee cup or mug.

The invention provides a significant improvement in the design and use of drinking containers. When filled with liquid contents to be consumed, the drinking container of the invention allows the contents of the container to be emptied with a minimal tilting angle of the cup 2. The angle of the wedge 4 determines when the drinking container will be emptied of drinking fluid. Once the surface of the wedge 4 is tilted up past horizontal, substantially all drinking fluid will drain from the container 2. The amount of tilt required is essentially the difference between the angle of the wedge member 4 and 90 degrees. Thus, if the wedge has an angle of 40 degrees relative to vertical, the container will empty completely when the container is tilted upward by 50 degrees from vertical. With a conventional sized mug or cup, approximately three ounces of drinking fluid will remain in the cup when it is tilted 50 degrees. The wedge is preferably set at between 30 and 60 degrees relative to vertical. Lower or greater angles can be used, but draining benefits are minimized at lower angles, and higher angles lead to loss of container volume.

To enhance the flow of liquid from the container, a flow channel or groove 12 is preferably formed in the middle of the internal wedge, thus providing the liquid with a specific flow channel. The flow channel 12 is positioned and configured to assist the fluid diverter member 4 in compelling fluid through the sipping region 16A. As shown most clearly in FIG. 1C, the flow channel 12 preferably extends lengthwise along an outer surface of the fluid diverter member 4. The channel is preferably continuous from the bottom 6 of the container 2 to the extension spout 8, in order to help prevent spillage as the container is emptied. In the preferred embodiment shown in FIG. 1C, the flow channel comprises a lengthwise groove formed by a pair of curved walls 13A, 13B.

The drinking container shown in FIG. 1 includes an extension spout 8 extending upward and outward from the upper rim 16. The sipping region 16A is formed on the upper end of the extension spout 8. As shown in FIG. 1, the extension spout 8 is contiguous with the fluid diverter member 4 to thereby assist the fluid diverter member 4 in compelling fluid through the sipping region 16A.

Figure 2A:
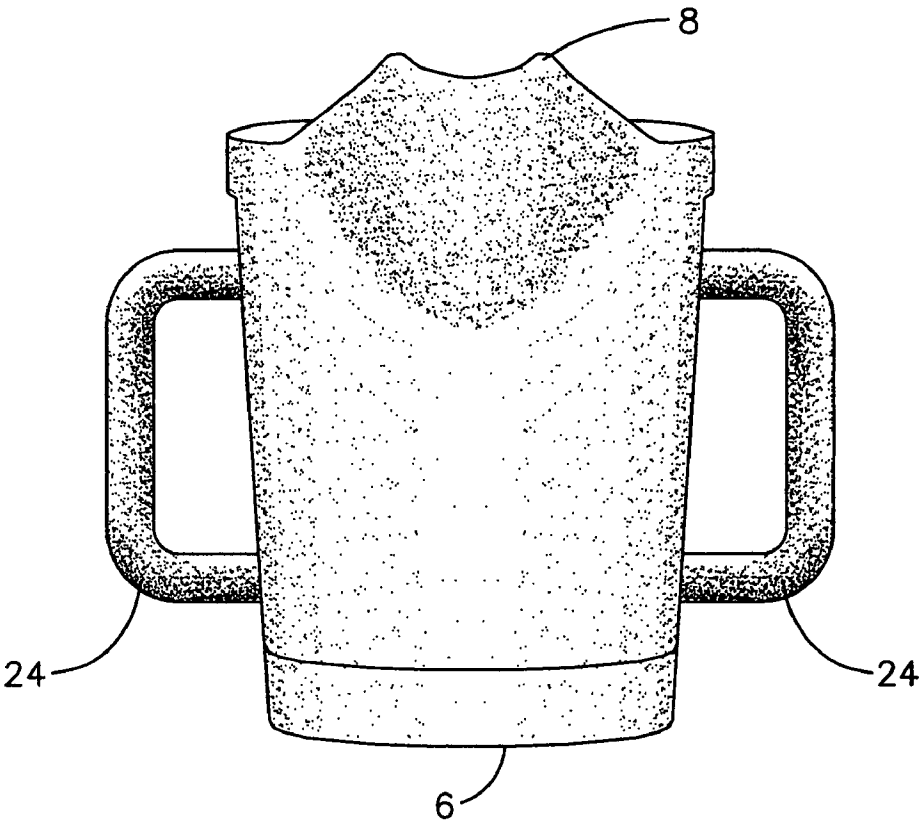
FIG. 2A is an external frontal view of one preferred embodiment of the invention, featuring a pair of opposing handles.
Figure 2B:
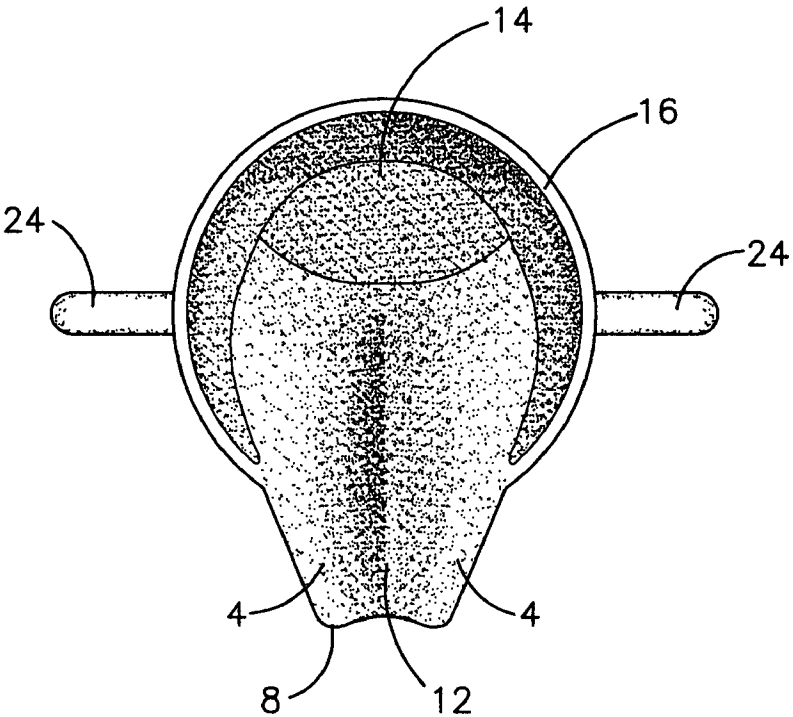
FIG. 2B is a top view of the drinking container of FIG. 2A, showing details of a fluid diverter member.
Figure 3A:
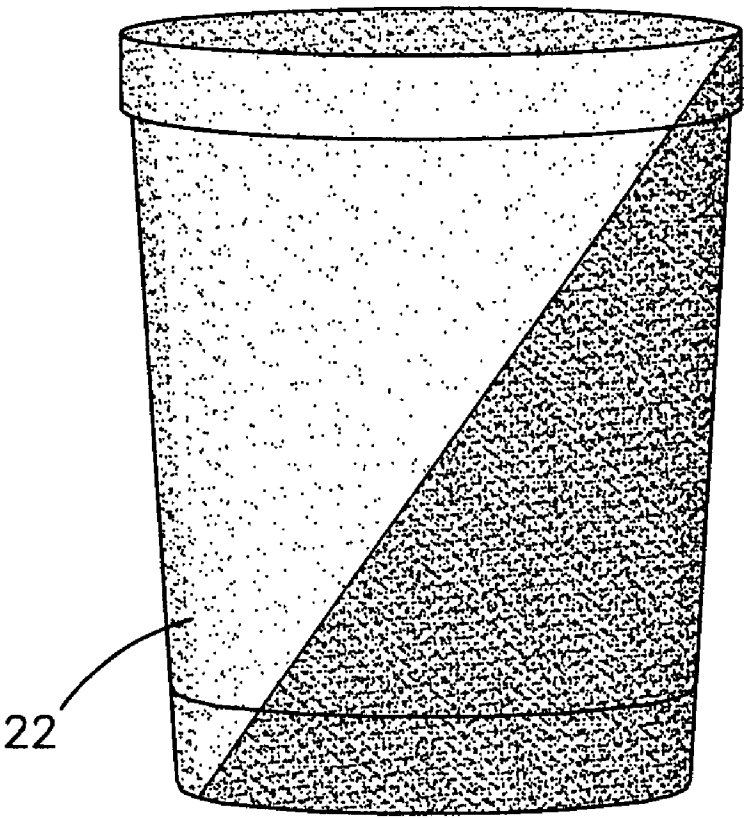
FIG. 3A is a cross section side view of one preferred embodiment of the invention, showing a cross section of a fluid diverter member.
Figure 3B:
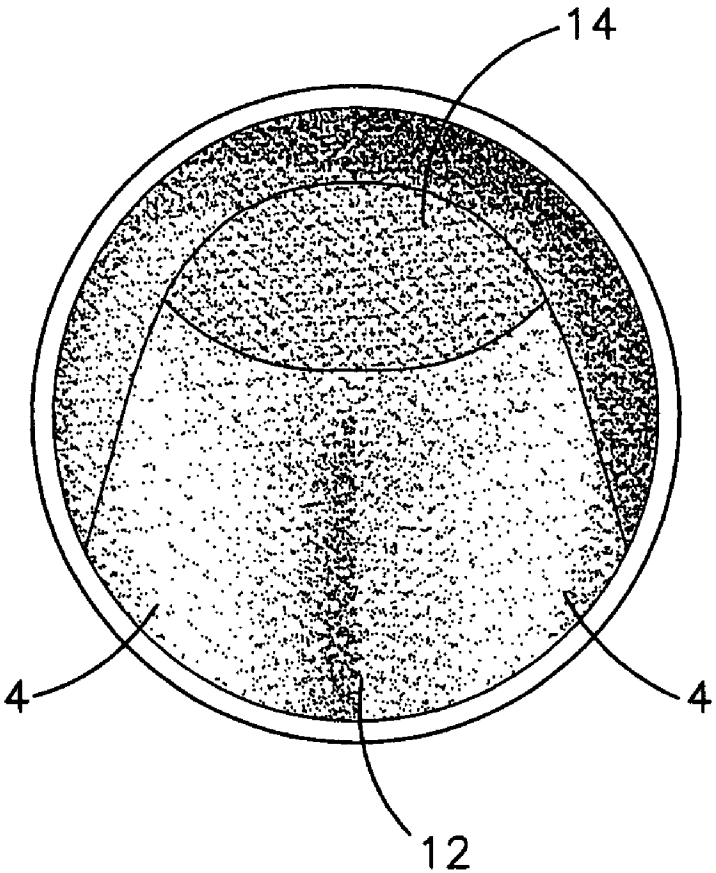
FIG. 3B is a top view of the drinking container of FIG. 3A, showing details of a fluid diverter member.

The container can be provided with no handles (a travel mug), one handle (on either the right or left hand side of the sipping region 16A), or two handles positioned on either side of the sipping region 16A (this embodiment is particularly helpful to individuals who have difficulty raising a cup using only one hand, such as elderly individuals). The handles are preferably set at a vertical orientation, and at about 90 degrees from the flow channel 12. The handles may be sized and configured to assist elderly and impaired individuals in holding, maneuvering, and tilting the cup 2. FIG. 1 shows the drinking container provided with a handle 18 on an outer surface of the vessel 2. The handle 18 is preferably positioned at about ninety degrees relative to the sipping region 16A, so as to assist a user in tilting the vessel 2 toward the user's mouth. FIG. 2 shows the drinking container 2 provided with a pair of handles 24 on an outer surface of the vessel. One of the handles 24 is preferably positioned at about 90 degrees relative to the sipping region 16A, and the other the handle 24 is preferably positioned at about 270 degrees relative to the sipping region 16A. FIG. 3 shows an embodiment in which the vessel 2 is provided without a handle, in the form of a travel mug. This configuration is particularly useful for situations in which the drinking container will be placed a circular drink holder, such as in a car or on a wheelchair.

Figure 4A:
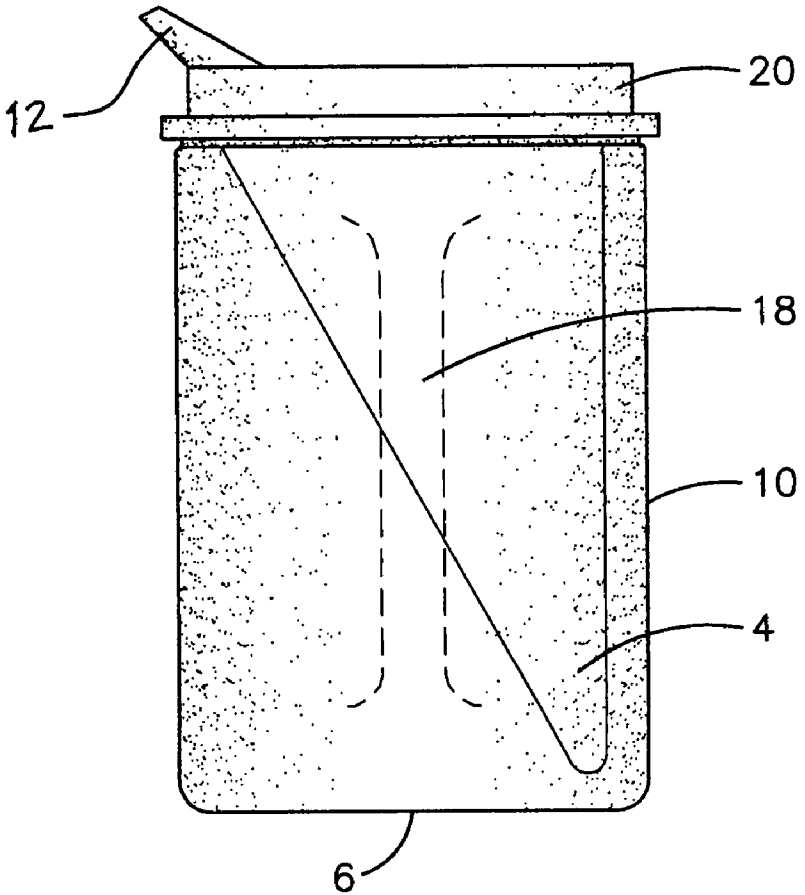
FIG. 4A is a cross section side view of one preferred embodiment of the invention, showing a cross section of a fluid diverter member and illustrating a removable cap.
Figure 4B:
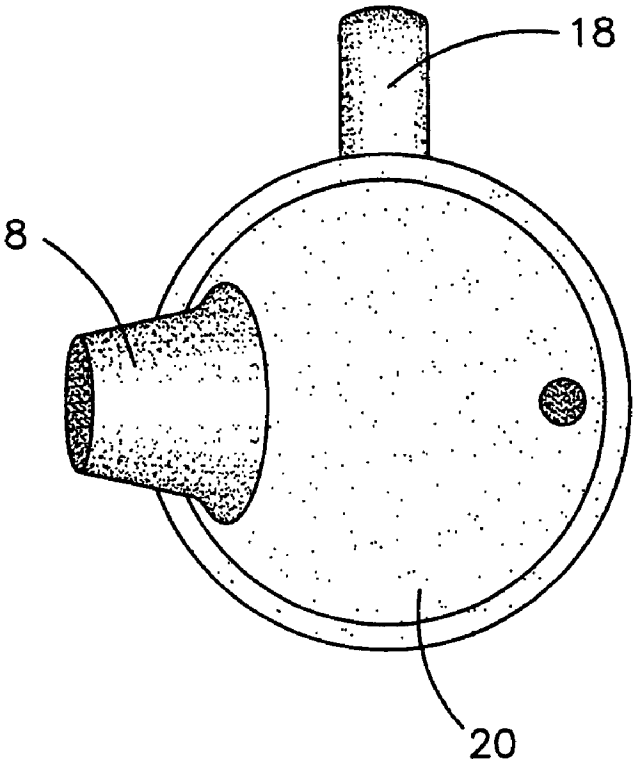
FIG. 4B is a top view of the drinking container of FIG. 4A, showing details of a cap featuring an extension spout.

As shown in FIG. 4, the drinking container can be provided with a lid 20 configured to removably seal the upper rim 16. The lid 20 preferably has an extension spout 8 configured to extend the fluid diverter member upward and outward to thereby assist the fluid diverter member 4 in compelling fluid through the sipping region 16A. The enclosed extension spout 8 is angled to substantially match the angle of the wedge 4, so as to cooperate with the wedge 4 and flow channel 12 in draining drinking fluid from the container 2. To help regulate the quality of fluids allowed to flow through the channel 12, an internal cap with multiple slots can be placed in the top of the container.

The drinking container 2 of the invention is particularly helpful for disabled individuals who have problems with dysphasia or aspiration when tilting their head back. The container 2 is also helpful to individuals who have difficulty with or are unable to lift their arm or shoulder due to injury, arthritis, or other ailments. The current invention also allows drivers to keep their eyes in contact with the road ahead because of the minimal angle necessary to empty the cup 2 keeps the cup below eye level.

In operation, the drinking container of the invention is used by filling the container 2 with a drinking fluid, placing the sipping region 16A of the drinking container on a lower lip of a mouth of the user, and rotating the bottom of the container 2 about the lower lip of the user to thereby compel the fluid to flow through the sipping region 16A. Because of the configuration of the container 2, this can be accomplished while the user maintains his or her head in a substantially fixed orientation, since the fluid diverter member 4 decreases the degree of tilt required to drain the fluid from the container 2 into the user's mouth. In order to avoid problems with residual drinking fluid draining into the lungs, the user preferably maintains their head in a vertical orientation during drinking.

Figure 5:
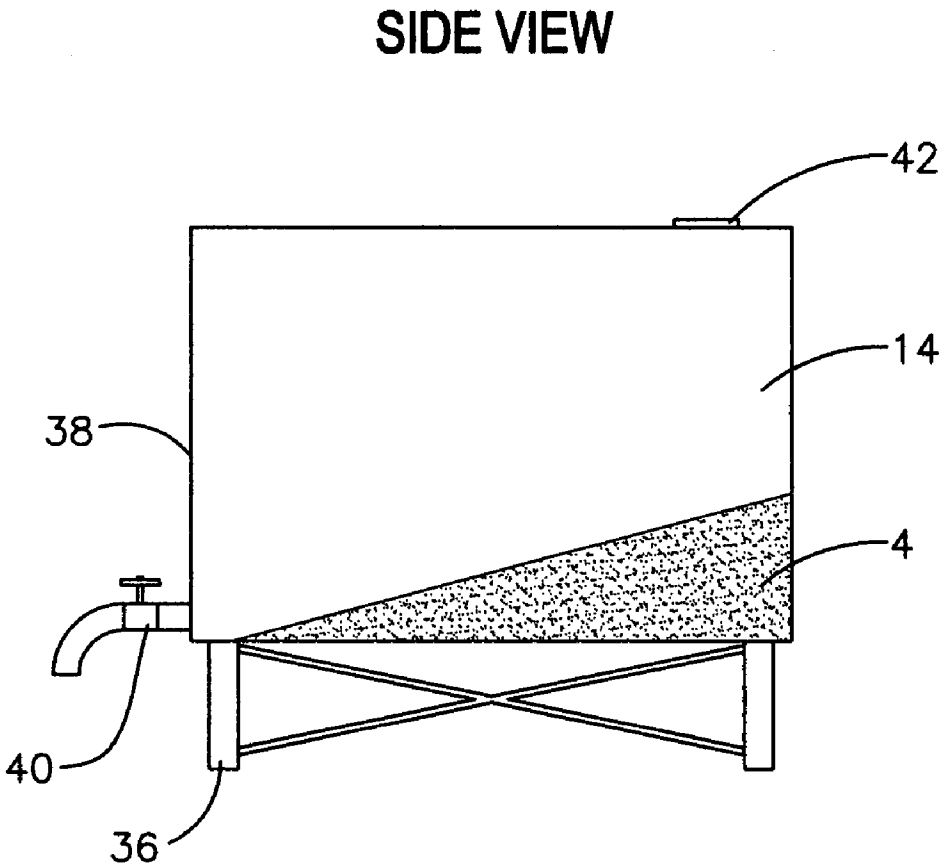
FIG. 5 is a cross-section side view of a tank featuring a fluid diverter member configured for compelling fluid through a spigot.
Figure 6:
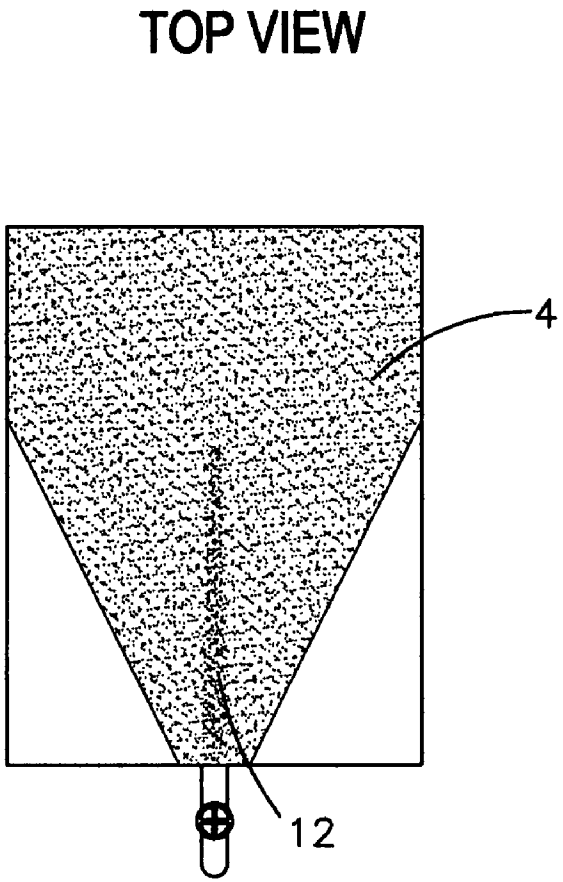
FIG. 6 is a cross-section top view of a tank, showing details of a fluid diverter member.

The foregoing principles may also be applied to liquid containers that are not used as drinking containers. The use of a wedge shaped member can assist in discharging liquid from a container such as a bucket or pail. An individual would normally be required to lift or tilt such a container near vertical in order to empty the container of liquid. Use of a wedge shaped impoundment member also allows large horizontal and vertical tanks to be completely emptied through a spigot without the need for tilting, and also speeds clean out of any residual material from the interior of the tank. FIGS. 5 and 6 demonstrate the use of a wedge shaped member 4 in a tank 38. The interior volume 14 of the tank 38 can be filled with liquid in a conventional manner, such as through capped inlet 42. As shown in FIG. 6, the wedge shaped member 4 may be provided with a flow channel 12. The tank has a conventional spigot 40 positioned near the bottom of the wedge shaped member 4.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A drinking container for assisting a disabled person in drinking a fluid by reducing the degree of tilt necessary to drain the fluid from the container into the person's mouth comprising:

a fluid holding vessel having an upper rim and a closed bottom, said upper rim having an opening through at least a sipping region thereof, a fluid diverter member contiguous with an inner surface and said bottom of said vessel, said diverter member sloping downward substantially from said sipping region of said rim toward an opposing side of said vessel such that when said bottom of said vessel is pivoted upward about said sipping region of said rim, said diverter member compels fluid through said sipping region.

2. The drinking container of claim 1, wherein said fluid diverter member is wedge shaped.

3. The drinking container of claim 1, further comprising a flow channel extending lengthwise along an outer surface of said fluid diverter member, said flow channel positioned and configured to assist said fluid diverter member in compelling fluid through said sipping region.

4. The drinking container of claim 1, further comprising a handle on an outer surface of said vessel, said handle positioned at about ninety degrees relative to said sipping region.

5. The drinking container of claim 1, further comprising a pair of handles on an outer surface of said vessel, one of said handles positioned at about 90 degrees relative to said sipping region, and the other of said handles positioned at about 270 degrees relative to said sipping region.

6. The drinking container of claim 1, wherein said sipping region comprises an extension spout extending upward and outward from said upper rim, said extension spout contiguous with said fluid diverter member to thereby assist said fluid diverter member in compelling fluid through said sipping region.

7. The drinking container of claim 1, further comprising a lid configured to removably seal said upper rim, said lid having an extension spout configured to extend said fluid diverter member upward and outward to thereby assist said fluid diverter member in compelling fluid through said sipping region.

8. A drinking container for assisting a disabled person in drinking a fluid by reducing the degree of tilt necessary to drain the fluid from the container into the person's mouth comprising:

a fluid holding vessel having an open upper rim and a closed bottom, an extension spout extending upward and outward from said upper rim, an upper portion of said extension spout forming a sipping region, a wedge-shaped fluid diverter member contiguous with an inner surface and said bottom of said vessel, said fluid diverter member sloping downward from said sipping region of said extension spout toward an opposing side of said vessel such that when said bottom of said vessel is pivoted upward about said sipping region, said diverter member compels fluid through said sipping region, and a flow channel extending lengthwise along an outer surface of said fluid diverter member, said flow channel positioned and configured to assist said fluid diverter member in compelling fluid through said sipping region.

9. The drinking container of claim 8, further comprising a handle on an outer surface of said vessel, said handle positioned at about ninety degrees relative to said sipping region.

10. The drinking container of claim 8, further comprising a pair of handles on an outer surface of said vessel, one of said handles positioned at about 90 degrees relative to said sipping region, and the other of said handles positioned at about 270 degrees relative to said sipping region.

11. A drinking container for assisting a disabled person in drinking a fluid by reducing the degree of tilt necessary to drain the fluid from the container into the person's mouth comprising:

a fluid holding vessel having an upper rim and a closed bottom, said upper rim having an opening through at least a sipping region thereof, a fluid diverter member having a wedge shape, said fluid diverter member disposed along one side of said vessel, said fluid diverter member contiguous with an inner surface and said bottom of said vessel such that fluid cannot seep behind said fluid diverter member, said fluid diverter member sloping downward substantially from said sipping region of said rim substantially to an opposite side of said vessel such that when said bottom of said vessel is pivoted upward about said sipping region of said rim, said diverter member compels fluid through said sipping region, and a flow channel extending lengthwise along an outer surface of said fluid diverter member substantially from said sipping region to said bottom of said vessel, said flow channel configured as a groove formed by a pair of curved walls.

12. The drinking container of claim 11, further comprising a handle on an outer surface of said vessel, said handle positioned at about ninety degrees relative to said sipping region.

13. The drinking container of claim 11, further comprising a pair of handles on an outer surface of said vessel, one of said handles positioned at about 90 degrees relative to said sipping region, and the other of said handles positioned at about 270 degrees relative to said sipping region.

14. The drinking container of claim 11, wherein said sipping region comprises an extension spout extending upward and outward from said upper rim, said extension spout contiguous with said fluid diverter member to thereby assist said fluid diverter member in compelling fluid through said sipping region.

15. The drinking container of claim 11, further comprising a lid configured to removably seal said upper rim, said lid having an extension spout configured to extend said fluid diverter member upward and outward to thereby assist said fluid diverter member in compelling fluid through said sipping region.

* * * * *